US010046436B2

(12) United States Patent
Flood et al.

(10) Patent No.: US 10,046,436 B2
(45) Date of Patent: Aug. 14, 2018

(54) DELAYED DIFFUSION OF NOVEL SPECIES FROM THE BACK SIDE OF CARBIDE

(71) Applicant: Diamond Innovations, Inc., Worthington, OH (US)

(72) Inventors: Gary Martin Flood, Canal Winhester, OH (US); Joel Vaughn, Groveport, OH (US)

(73) Assignee: Diamond Innovations, Inc., Worthington, OH (US)

( * ) Notice: Subject to any disclaimer, the term of this patent is extended or adjusted under 35 U.S.C. 154(b) by 348 days.

(21) Appl. No.: 14/827,342

(22) Filed: Aug. 17, 2015

(65) Prior Publication Data

US 2015/0352688 A1 Dec. 10, 2015

Related U.S. Application Data

(63) Continuation of application No. 13/836,155, filed on Mar. 15, 2013, now Pat. No. 9,108,301.

(51) Int. Cl.

| | |
|---|---|
| ***B22F 7/00*** | (2006.01) |
| ***B24D 3/06*** | (2006.01) |
| ***B24D 99/00*** | (2010.01) |

(52) U.S. Cl.

CPC ..... *B24D 3/06* (2013.01); *B24D 99/00* (2013.01); *B24D 99/005* (2013.01)

(58) Field of Classification Search

CPC .... C22C 1/05; B22F 7/08; B01J 3/062; E21B 10/46

See application file for complete search history.

(56) References Cited

U.S. PATENT DOCUMENTS

| | | | | |
|---|---|---|---|---|
| 7,616,734 | B1 * | 11/2009 | Corbett | G01N 23/223 378/46 |
| 2008/0230280 | A1 * | 9/2008 | Keshavan | C22C 1/05 175/434 |
| 2008/0302579 | A1 * | 12/2008 | Keshavan | B22F 7/08 175/434 |
| 2013/0092451 | A1 * | 4/2013 | Mukhopadhyay | B01J 3/062 175/428 |

* cited by examiner

*Primary Examiner* — Pegah Parvini

(74) *Attorney, Agent, or Firm* — Eric Shaffer

(57) ABSTRACT

A polycrystalline diamond compact (PDC) is fabricated using a process of delayed diffusion (i.e., post-sintering) of a diffusion species (i.e., a metalloid) introduced from the back side of a carbide further away from the diamond grit or from the flank side of the carbide, as opposed to the side of the carbide adjacent to the diamond grit. The process of fabricating the PDC includes depositing, in a metal container, a synthetic diamond grit, a carbide, and a diffusion species, then applying a high pressure and high temperature (HPHT) to the contents of the metal container wherein (1) the carbide diffuses across the diamond grit, and (2) the diffusion species diffuses across the carbide followed by the diamond grit, thus providing a protective coating to the PDC.

16 Claims, 3 Drawing Sheets

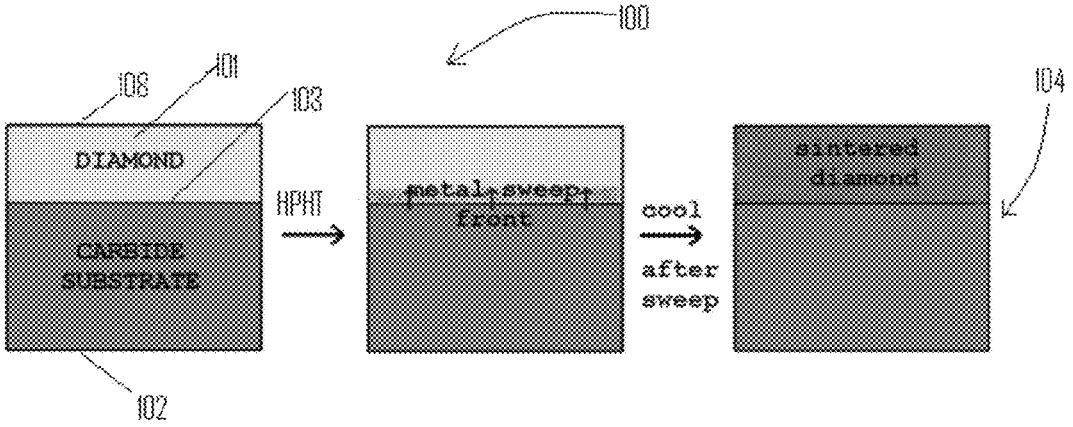
FIG. 1 (Conventional)

DELAYED DIFFUSION OF NOVEL SPECIES FROM THE BACK SIDE OF CARBIDE

CROSS REFERENCE TO RELATED APPLICATIONS

This application is a continuation of U.S. patent application Ser. No. 13/836,155 (and issued as U.S. Pat. No. 9,108,301), filed on Mar. 15, 2013, the entire disclosure of which is hereby incorporated by reference.

TECHNICAL FIELD AND INDUSTRIAL APPLICABILITY

The present disclosure relates to a polycrystalline diamond compact (PDC). More specifically, the present disclosure relates to a PDC that is fabricated using a process of delayed diffusion of a diffusion species (e.g., a metalloid) introduced from the back side of a carbide away from the diamond grit or from the flank side of the carbide, as opposed to the side of the carbide adjacent to the synthetic diamond grit.

BACKGROUND

In the discussion that follows, reference is made to certain structures and/or process. However, the following references should not be construed as an admission that these structures and/or process constitute prior art. Applicant expressly reserves the right to demonstrate that such structures and/or process do not qualify as prior art against the present invention.

In conventional polycrystalline diamond compact processes (PDC), high pressure and high temperature (HPHT) is applied to diamond powder that is adjacent to a cemented carbide substrate, pre-sintering. During sintering, the binder of the carbide sweeps through the diamond powder to create the PDC. In conventional processes, a cobalt (Co) disc layer doped with silicon (Si) is placed between the diamond powder and the carbide prior to sintering in order to introduce silicon to protect the PDC from graphitization. Unfortunately, during the sweep, the silicon is present during the sintering process. Consequently, silicon carbide (SiC) is formed and prevents the diamond grains from being well sintered together. FIG. 1 shows a flow diagram 100 of a conventional process of creating a polycrystalline diamond compact (PDC) 104. In the conventional process, a diamond powder/grit 101 is deposited in a metal container 108, where the diamond powder/grit 101 is adjacent to a cemented carbide substrate 102. To manufacture the PDC, high pressure and high temperature (HPHT) is applied to commence sintering. After the HPHT process is started, a binder content originating in the cemented carbide substrate 102, such as cobalt, sweeps across the top face 103 between the cemented carbide substrate 102 and the diamond powder/grit 101 to inside of the diamond powder/grit 101. After a period of time, e.g., from 10 seconds to 10 minutes, when sweeping is completed, the sintered diamond/PDC 104 are left to cool. The presence of Si in the cemented carbide substrate 102 layer may hinder the production of a good PDC 104 by either creating silicon carbide (SiC) phases between the diamond powder/grit 101, or through some other hindering mechanism. This hindering manifests itself in sweeping cobalt silicide or chromium silicide, for example. Poor performance has been observed, such as poor wear resistance and delamination, for example.

Although one solution to the sweeping of the Si across the cemented carbide substrate 102 layer is to not use the Co disc doped with Si, it is desired that the PDC 104 be protected from, for example, graphitization during drilling due to a silicon carbide (SiC) coating around the pores between of the diamond grains.

SUMMARY

This disclosure describes an improved PDC fabrication process and the PDC created using the improved process.

In an exemplary embodiment, a process of fabricating a polycrystalline diamond compact (PDC) includes depositing, in a metal container, a diamond grit, a cemented carbide having a binder content, and a diffusion species, then applying a high pressure and high temperature (HPHT) to the contents of the metal container where (1) the cemented carbide binder infiltrates across the diamond grit, and (2) the diffusion species diffuses across the cemented carbide then into the diamond grit, thus providing a protective coating to the diamond grains within the PDC.

In a further exemplary embodiment, a polycrystalline diamond compact (PDC) prepared by a process includes the steps of: depositing, in a metal container, a first amount of a diamond grit; depositing, in the metal container, a second amount of a cemented carbide having a binder content; depositing, in the metal container, a third amount of a diffusion species; and applying a high pressure and high temperature to the diamond grit, the carbide, and the diffusion species, where, first, the carbide binder infiltrates across the diamond grit, and where, second, the diffusion species diffuses across the carbide and then the diamond grit.

In another exemplary embodiment, a polycrystalline diamond compact may comprise a substrate having a binder content; and a polycrystalline diamond layer bonded to the substrate, wherein the binder content of the substrate infiltrated into the polycrystalline diamond layer is encircled by a diffusion species, wherein the diffusion species is a metalloid.

BRIEF DESCRIPTION OF THE DRAWINGS

The following detailed description of preferred embodiments can be read in connection with the accompanying drawings in which like numerals designate like elements and in which:

FIG. 1 shows a flow diagram of a conventional process of creating a polycrystalline diamond compact (PDC);

DETAILED DESCRIPTION

Figure 2:
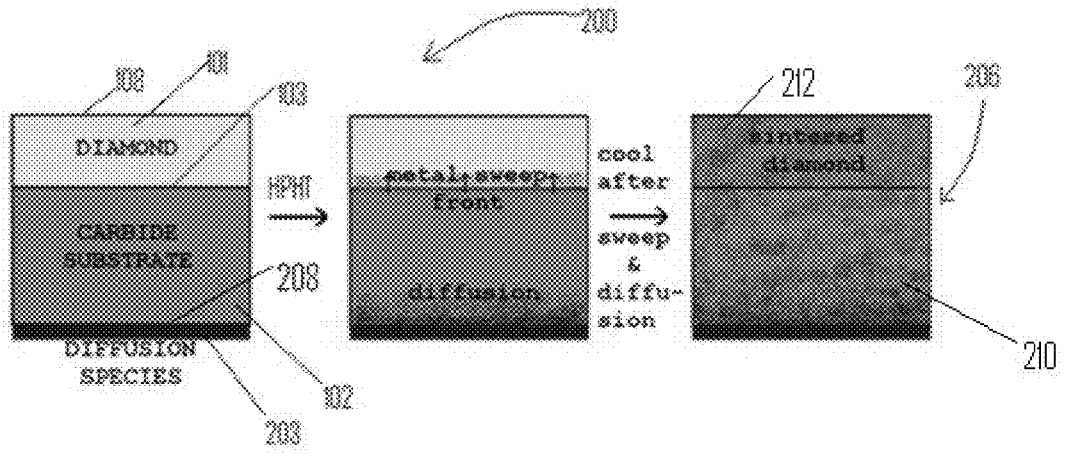
FIG. 2 shows an exemplary flow diagram of an improved process of fabricating a polycrystalline diamond compact (PDC)

Before the present methods, systems and materials are described, it is to be understood that this disclosure is not limited to the particular methodologies, systems and materials described, as these may vary. It is also to be understood that the terminology used in the description is for the purpose of describing the particular versions or embodiments only, and is not intended to limit the scope. For example, as used herein, the singular forms "a," "an," and "the" include plural references unless the context clearly dictates otherwise. In addition, the word "comprising" as used herein is intended to mean "including but not limited to."Unless defined otherwise, all technical and scientific terms used herein have the same meanings as commonly understood by one of ordinary skill in the art.

Unless otherwise indicated, all numbers expressing quantities of ingredients, properties such as size, weight, reaction conditions and so forth used in the specification and claims are to be understood as being modified in all instances by the term "about". Accordingly, unless indicated to the contrary, the numerical parameters set forth in the following specification and attached claims are approximations that may vary depending upon the desired properties sought to be obtained by the invention. At the very least, and not as an attempt to limit the application of the doctrine of equivalents to the scope of the claims, each numerical parameter should at least be construed in light of the number of reported significant digits and by applying ordinary rounding techniques.

As used herein, the term "about" means plus or minus 10% of the numerical value of the number with which it is being used. Therefore, about 50 means in the range of 45-55.

As used herein, the term "superabrasive particles" may refer to ultra-hard particles having a Knoop hardness of 5000 KHN or greater. The superabrasive particles may include diamond, cubic boron nitride, for example. The term "substrate" as used herein means any substrate over which the superabrasive layer is formed. For example, a "substrate" as used herein may be a transition layer formed over another substrate.

As used herein, the term "metalloid" may refer to a chemical element with properties that are in between or a mixture of those of metals and nonmetals, and which is considered to be difficult to classify unambiguously as either a metal or a nonmetal. Metalloids may include specifically Si, B, Ge, Sb, As, and Te, for example.

It is an object of the exemplary embodiments described herein to illustrate a PDC process, and a PDC manufactured by such process, where a metalloid such as SiC is added as a protective coating on the diamond powder, post-sintering, to protect the diamond from back-conversion (the process by which diamond converts back to graphite). The SiC would result in a desired lower coefficient of thermal expansion (CTE) in pore spaces between the diamond grains. It is another object of the exemplary embodiments to illustrate a process of fabricating a PDC where Si diffuses across the carbide from its back side, i.e., the side of the carbide opposite the side adjacent to the diamond powder. Other metalloids besides Si, for example, cobalt silicide (CoSi), may be used. The diffusion process is not limited to the use of Si on the back side of the carbide.

Accordingly, exemplary embodiments are directed to a process for fabricating a polycrystalline diamond compact (PDC), and a PDC produced by the process, that substantially obviates one or more problems due to limitations and disadvantages of the related art by delayed diffusion of a novel species from the back side of a carbide.

FIG. 2 shows an exemplary flow diagram 200 of an improved process of fabricating a polycrystalline diamond compact (PDC) 206. In the improved process, a diamond powder/grit 101 is deposited into a metal container 108 made of, for example, a refractory metal such as tantalum (Ta) or molybdenum (Mo). A cemented carbide substrate 102 layer is deposited, adjacent to the diamond powder/grit 101. A diffusion species 203 such as silicon, for example, which is introduced to protect the PDC from graphitization, is also deposited. The diffusion species 203 is placed on the side 208 of the cemented carbide substrate 102 that is opposite a top side 103 of the cemented carbide substrate 102 which is adjacent to the diamond powder/grit 101 in such a way that the second amount of the carbide 102 may be sandwiched between the first amount of diamond grit 101 and the third amount of the diffusion species 203. The diffusion species 203 layer includes at least one element (e.g., silicon (Si) or tungsten (W)). Some other elements that may be used include, for example, Cr, Ti, V, Zr, Mo, W, Nb, Sc, Y, Ta, B, and Ru. To commence sintering of the foregoing contents of the metal container, high pressure and high temperature (HPHT) is applied to the contents of the metal container.

It may take time for the diffusion species 203, such as metalloid, to diffuse through the liquid cobalt inside the carbide at HPHT. Several factors may affect speed of diffusion, such as temperature, diffusivity, melting point of the diffusion species, and solubility of the diffusion species in the binder content, such as cobalt, for example. After the HPHT process ends and sintering has been completed, the binder content, such as cobalt inside the fabricated PDC 206 may have a diffusion species, such as a silicon carbide (SiC), protective coating in such a way that cobalt may have limited or no direct contact with diamond grits and diamond grits may not be converted back to graphite under cobalt catalyst. The deposited SiC may cause the PDC 206 to have a lower coefficient of temperature expansion (CTE) in the pore spaces between diamond powders/grits 101.

Other metalloids besides Si may be introduced from the back side of the cemented carbide substrate 202 layer in order to achieve similar benefits to those provided to the PDC 206 through the introduction of Si. Examples of these other metalloids that may contain at least one of silicon (Si), cobalt silicide (CoSi), Cr, Ti, V, Zr, Mo, W, Nb, Sc, Y, Ta, B, and Ru. And their potential effects may be increasing thermal stability of PDC, increasing erosion and corrosion of carbide, and increasing abrasion resistance of carbide, for example.

In the exemplary flow diagram 200 of the improved process of fabricating a PDC, a first amount of diamond powder/grit 201 may be, for example, approximately from about 1.0 g to about 3.0 g. A second amount of carbide may have a thickness, for example, approximately from about 2 mm to about 20 mm. A third amount of a metalloid, such as Si or CoSi, may have a thickness, for example, approximately from about 0.01 mm to about 1 mm.

Still in FIG. 2, the sintered polycrystalline diamond compact 206 may comprise a substrate 210 having the binder content, such as cobalt; and a polycrystalline diamond table 212 bonded to the substrate 210, wherein the binder content of the substrate 210 infiltrated into the polycrystalline diamond table that is encircled by the diffusion species, such as metalloid, which may be at least one of silicon (Si), cobalt silicide (CoSi), Cr, Ti, V, Zr, Mo, W, Nb, Sc, Y, Ta, B, and Ru. The diffusion species causes the polycrystalline diamond table to have a lower coefficient of temperature expansion (CTE) in pore spaces between diamond grits.

Figure 3:
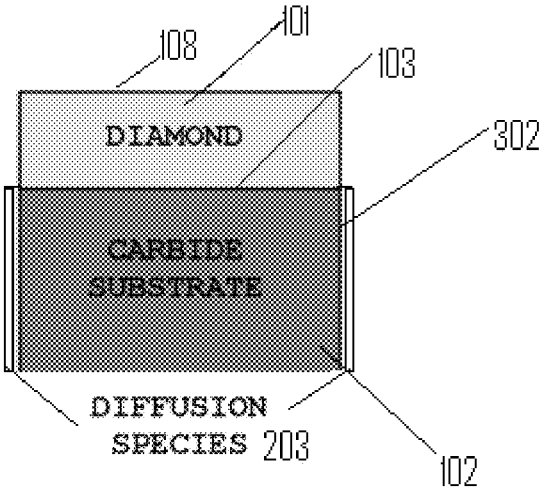
FIG. 3 shows another exemplary cell design for an improved process of fabricating a polycrystalline diamond compact.

In another exemplary embodiment, as shown in FIG. 3, when the carbide has a top surface 103 and a flank surface 302, wherein the top surface 103 is attached to and circumscribed by the flank surface 302, the diffusion species 203 may be disposed close to the flank surface 302 and parallel to the flank surface 302 of the carbide 102. Under HPHT, the binder content inside the substrate 102 may infiltrate cross the top surface 103 of the substrate 102 and into the diamond grits 101. When the temperature goes up to the melting point of the diffusion species 203, the diffusion species may diffuse into the cemented carbide substrate 102 and diamond grits 101. Compared to the method shown in FIG. 2, the distance and time for the diffusion species to diffuse into the diamond grits 101 may be shorter than that by the method shown in FIG. 2.

Figure 4:
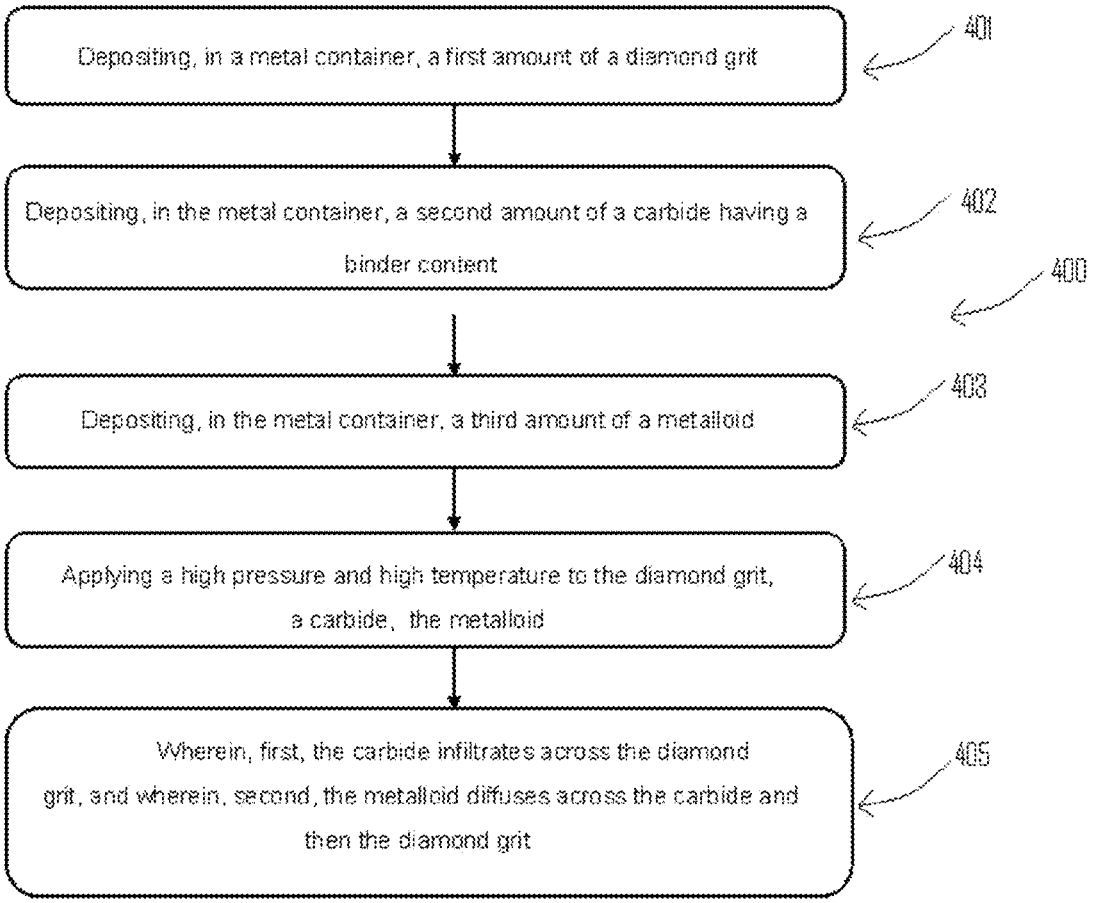
FIG. 4 shows an exemplary flow diagram of steps of an improved process of fabricating a polycrystalline diamond compact (PDC).

FIG. 4 shows an exemplary flow diagram 400 of steps 401-405 of an improved process of fabricating a polycrystalline diamond compact (PDC). The process includes: depositing, in a metal container, a first amount of a diamond grit in step 401; depositing, in the metal container, a second amount of a carbide having a binder content in step 402; depositing, in the metal container, a third amount of a diffusion species, such as a metalloid in step 403; and applying a high pressure and high temperature to the diamond grit, carbide, and the metalloid in step 404, wherein, first, the carbide diffuses across the diamond grit, and wherein, second, the metalloid diffuses in series across the carbide and then across the diamond grit in step 405.

The exemplary flow diagram 400 may further include steps of increasing corrosion resistance, erosion resistance, and wear resistance of the carbide by incorporating the diffusion species; increasing thermal stability of the carbide by incorporating the diffusion species; finishing the polycrystalline diamond compact into a desired final dimension. The finishing step may include at least one of grinding, lapping, turning, polishing, bonding, heating, and chamfering. As discussed above, the exemplary flow diagram 400 may further comprise a step of causing the diamond grits to have a lower coefficient of temperature expansion in pore spaces between diamond grits by surrounding the binder content, such as cobalt with the diffusion species.

One or more steps may be inserted in between or substituted for each of the foregoing steps 401-405 without departing from the scope of this disclosure.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A polycrystalline diamond compact, comprising:
a substrate having a binder content; and
a polycrystalline diamond layer bonded to the substrate, wherein the binder content of the substrate is infiltrated into the polycrystalline diamond layer and is encircled by a diffusion species, wherein the diffusion species is made of a different material than is the binder content of the substrate.

2. The polycrystalline diamond compact of claim 1, wherein the binder content of the substrate comprises cobalt.

3. The polycrystalline diamond compact of claim 1, wherein the diffusion species includes at least one of silicon (Si) or cobalt silicide (CoSi), Cr, Ti, V, Zr, Mo, W, Nb, Sc, Y, Ta, B, and Ru.

4. The polycrystalline diamond compact of claim 1, wherein the diffusion species causes the polycrystalline diamond layer to have a lower coefficient of thermal expansion in the pore spaces between diamond grains.

5. A polycrystalline diamond compact, comprising:
a cemented carbide binder;
a substrate having a binder content; and
a polycrystalline diamond layer bonded to the substrate, the polycrystalline diamond layer comprising a plurality of diamond grains sintered to one another and separated by a plurality of pore spaces, wherein the plurality of the pore spaces includes binder content that is at least partially surrounded by a diffusion species that diffuses across the cemented carbide binder and that is made from a different material than is the binder content of the substrate.

6. The polycrystalline diamond compact of claim 5, wherein the diffusion species spaces the binder content away from at least portions of a diamond grain.

7. The polycrystalline diamond compact of claim 5, wherein the binder content of the substrate comprises cobalt.

8. The polycrystalline diamond compact of claim 5, wherein the diffusion species includes at least one of silicon (Si) or cobalt silicide (CoSi), Cr, Ti, V, Zr, Mo, W, Nb, Sc, Y, Ta, B, and Ru.

9. The polycrystalline diamond compact of claim 5, wherein the diffusion species includes silicon, silicon carbide, or combinations of the same.

10. The polycrystalline diamond of claim 5, wherein the diffusion species has a lower coefficient of thermal expansion than the binder content.

11. A polycrystalline diamond compact, comprising:
a diamond powder grit deposited into a metal container;
a cemented carbide substrate layer located adjacent to the diamond powder grit;
a diffusion species introduced to protect the polycrystalline diamond compact from graphitization wherein the diffusion species is located on the side of the cemented carbide substrate opposite a top side of the cemented carbide substrate located adjacent to the diamond powder grit such that the cemented carbide is sandwiched between the diamond grit and the diffusion species.

12. The polycrystalline diamond compact of claim 11, wherein the diffusion species spaces the binder content away from at least portions of a diamond grain.

13. The polycrystalline diamond compact of claim 11, wherein the binder content of the substrate comprises cobalt.

14. The polycrystalline diamond compact of claim 11, wherein the diffusion species includes at least one of silicon (Si) or cobalt silicide (CoSi), Cr, Ti.

15. The polycrystalline diamond compact of claim 11, wherein the diffusion species includes at least one of silicon (Si) or cobalt silicide (CoSi), Cr, Ti, V, Zr, Mo, W, Nb, Sc, Y, Ta, B, and Ru.

16. The polycrystalline diamond compact of claim 11, wherein the diffusion species causes the polycrystalline diamond layer to have a lower coefficient of thermal expansion in the pore spaces between diamond grains.

* * * * *